US010486855B1

(12) United States Patent
Pollman

(10) Patent No.: US 10,486,855 B1
(45) Date of Patent: Nov. 26, 2019

(54) VERTICAL BURIAL CONTAINMENT SYSTEM

(71) Applicant: The United States of America, as represented by the Secretary of the Navy, Arlington, VA (US)

(72) Inventor: Anthony Gerard Pollman, Monterey, CA (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 160 days.

(21) Appl. No.: 15/909,590

(22) Filed: Mar. 1, 2018

Related U.S. Application Data

(60) Provisional application No. 62/574,009, filed on Oct. 18, 2017.

(51) Int. Cl.

| | |
|---|---|
| ***A61G 17/00*** | (2006.01) |
| ***B65D 21/02*** | (2006.01) |
| ***B65D 43/02*** | (2006.01) |
| *B65D 51/24* | (2006.01) |

(52) U.S. Cl.
CPC ..... *B65D 21/0228* (2013.01); *B65D 43/0229* (2013.01); *B65D 51/242* (2013.01)

(58) Field of Classification Search
CPC ..... B65D 21/0228; B65D 21/083; B65D 43/0229; A61G 17/08; E04H 13/008
USPC ..... 220/4.04, 567.1, 3.94, 4.07, 4.08, 4.26, 220/4.27, 484, 297
See application file for complete search history.

(56) References Cited

U.S. PATENT DOCUMENTS

| | | | | |
|---|---|---|---|---|
| 3,188,712 | A | 6/1965 | Bauermeister | |
| 3,348,280 | A | 10/1967 | Myers | |
| 3,581,452 | A | 6/1971 | Jalbert | |
| 3,681,820 | A | 8/1972 | Jalbert | |
| 3,898,718 | A | 8/1975 | Eubank | |
| 3,918,133 | A | 11/1975 | Schmitz | |
| 3,940,894 | A | 3/1976 | Nunes | |
| 4,328,606 | A | 5/1982 | Nunes | |
| 4,642,999 | A * | 2/1987 | Justice | B65D 81/3879 220/4.26 |
| 5,417,327 | A * | 5/1995 | Saumure | B65D 21/0228 206/427 |

(Continued)

*Primary Examiner* — Robert Poon
(74) *Attorney, Agent, or Firm* — Naval Postgraduate School; James B. Potts; Lisa A. Norris

(57) ABSTRACT

A vertical burial container comprising a midsection containment, upper cylindrical lid, interior volume, and a domed upper lid. The midsection containment comprises internal threads surrounding the upper circular opening and comprises a set of external threads surrounding the base. The external threads and the internal threads are mating threads to allow multiple containers to be threadably engaged for handling as a single unit. An upper cylindrical lid having external threads mated with the internal threads allows isolation of the interior volume of the midsection containment. Additionally, the vertical burial system additionally comprises an upper lid with internal threads for threadable engage with the internal threads. The various threads have respective thread lengths to accommodate either an upper lid or another midsection containment to be threadably engaged into the internal threads without displacing the inner cylindrical lid isolating the interior volume.

18 Claims, 4 Drawing Sheets

(56) References Cited

U.S. PATENT DOCUMENTS

| | | | | | |
|---|---|---|---|---|---|
| 5,774,918 | A * | 7/1998 | Cassell | A21C 9/00 | 7/111 |
| 5,815,897 | A * | 10/1998 | Longstreth | A61G 17/08 | 27/1 |
| 6,295,705 | B1 * | 10/2001 | Gersten | A61G 17/08 | 220/4.27 |
| 6,421,890 | B1 * | 7/2002 | Biggar | A61G 17/08 | 220/23.83 |
| 6,493,911 | B1 * | 12/2002 | Troin | A61G 17/08 | 125/20 |
| 6,520,606 | B1 * | 2/2003 | Robinson | A61G 17/08 | 27/1 |
| 7,703,186 | B1 | 4/2010 | Williamson | | |
| 8,479,362 | B2 | 7/2013 | Scruggs | | |
| 2004/0149617 | A1 * | 8/2004 | Schutz | B65D 1/16 | 206/503 |
| 2010/0031483 | A1 | 2/2010 | Scruggs | | |
| 2010/0200438 | A1 * | 8/2010 | Davies | B65D 21/083 | 206/223 |
| 2013/0111726 | A1 * | 5/2013 | Krieger | B65D 21/022 | 29/428 |
| 2014/0069917 | A1 * | 3/2014 | Meyers | B65D 21/022 | 220/23.88 |

* cited by examiner

VERTICAL BURIAL CONTAINMENT SYSTEM

RELATION TO OTHER APPLICATIONS

This patent application is a nonprovisional of and claims benefit from U.S. Provisional application 62/574,009 filed Oct. 18, 2017, which is hereby incorporated by reference in its entirety.

FIELD OF THE INVENTION

One or more embodiments relates generally to an vertical burial container having mechanical characteristics allowing multiple closed containments to be mated for handling as a single rigid body.

BACKGROUND

Underground burial containers are frequently utilized for the secure and undisturbed storage of materials. However, in certain circumstances, land available as use for burial sites is scarce in many urbanized areas. As a result, there are many different burial container systems seeking to minimize the ground level footprint required.

One approach to minimizing the ground level footprint would be to provide a vertically oriented burial container capable of longitudinal mechanical mating with another substantially identical burial container, in order to allow insertion of multiple units without increasing the ground level footprint required. Such a system could also allow for assembly and disassembly above ground and subsequent handling of the multiple burial containers as a single rigid structure, as well as providing structural strength in a buried posture. The mechanical mating capability among like units would also ease removal, subsequent addition of further containers, and reburial in a logistically simpler manner. It would be additionally advantageous to provide a means for inserting and maintaining a divider between the interior volumes of the various mated containers, so that any necessary handling can occur without disturbance or exposure of any contents therein.

These and other objects, aspects, and advantages of the present disclosure will become better understood with reference to the accompanying description and claims.

SUMMARY

The disclosure provides a vertical burial containment comprising a generally cylindrical midsection containment having an upper circular opening surrounding a longitudinal axis. The longitudinal axis extends through the upper circular opening. The midsection containment further comprises a midsection cylindrical wall having internal threads adjacent to the upper circular opening and surrounding the longitudinal axis and additionally comprises an externally threaded base attached to the midsection cylindrical wall and opposite the upper circular opening. The externally threaded base is intersected by the longitudinal axis and comprises external threads surrounding longitudinal axis, where the external threads are dimensioned as mating threads to the internal threads, in order to allow successive mating of substantially identical midsection containments.

The vertical burial containment further comprises an inner cylindrical lid comprising external lid threads. The external lid threads and internal threads of the midsection containment are additionally mating threads, in order to allow mechanical mating of the inner cylindrical lid and the midsection containment in a manner that isolate the interior volume of the midsection containment. Further, to allow mechanical mating of multiple midsection containments without removal of the inner cylindrical lid, the lid thread length of the external lid threads added to the external thread length of the external threads of the midsection containment is less than or equal to the internal thread length of the internal threads comprising the midsection containment.

The vertical burial containment additionally comprises an upper lid comprising a domed section and a support drum, with the support drum comprising external upper lid threads. The external upper lid threads are additionally mating threads to the internal threads of the midsection containment, to threadable engagement and fastening to the midsection containment. In order to allow threaded engagement of either an upper lid or an additional midsection containment, the upper lid thread length of the external upper lid threads added to the external thread length of the external lid threads of the inner cylindrical lid is less than or equal to the internal thread length of the internal threads comprising the midsection containment. The domed section of the upper lid further comprises a topmost opening allowing insertion of an external plug and a lifting fixture, so that a lifting force may be applied for the handling of a plurality of mated containers as a single rigid unit.

The novel system, apparatus, and principles of operation are further discussed in the following description.

Embodiments in accordance with the invention are further described herein with reference to the drawings.

DETAILED DESCRIPTION OF THE INVENTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a vertical burial container system allowing mechanical mating between a midsection containment, inner cylindrical lid, upper lid, and additional midsection containments in a manner allowing handling as a single unit.

Provided here is a vertical burial container comprising a midsection containment, upper cylindrical lid, and a domed upper lid. The midsection containment is has a substantially annular shape with an external and internal surface, and further comprises a base attached to and closing one end of the annulus. The open end of the annulus comprises an upper circular opening for access to the interior volume therein. The vertical burial container further comprises a set of internal threads generally adjacent and surrounding the upper circular opening, and additionally includes a set of external threads surrounding the base. The external threads and the internal threads are mating threads, in order that multiple containers may be threadably engaged for handling as a single unit. The vertical burial container further comprises an upper cylindrical lid having external threads allowing the upper cylindrical lid to threadably engage with the internal threads of the midsection containment, isolating the interior volume. The vertical burial system additionally comprises an upper lid having internal threads which threadably engage with the internal threads of the midsection containment. The upper lid allows a lifting fixture to be mechanically attached in order that a lifting force applied to the lifting fixture may act throughout a plurality of mated containers for handling as a single unit. Typically the various threads have respective thread lengths to accommodate either an upper lid or another midsection containment to be threaded into the internal threads without displacing the inner cylindrical lid isolating the interior volume.

Figure 1:
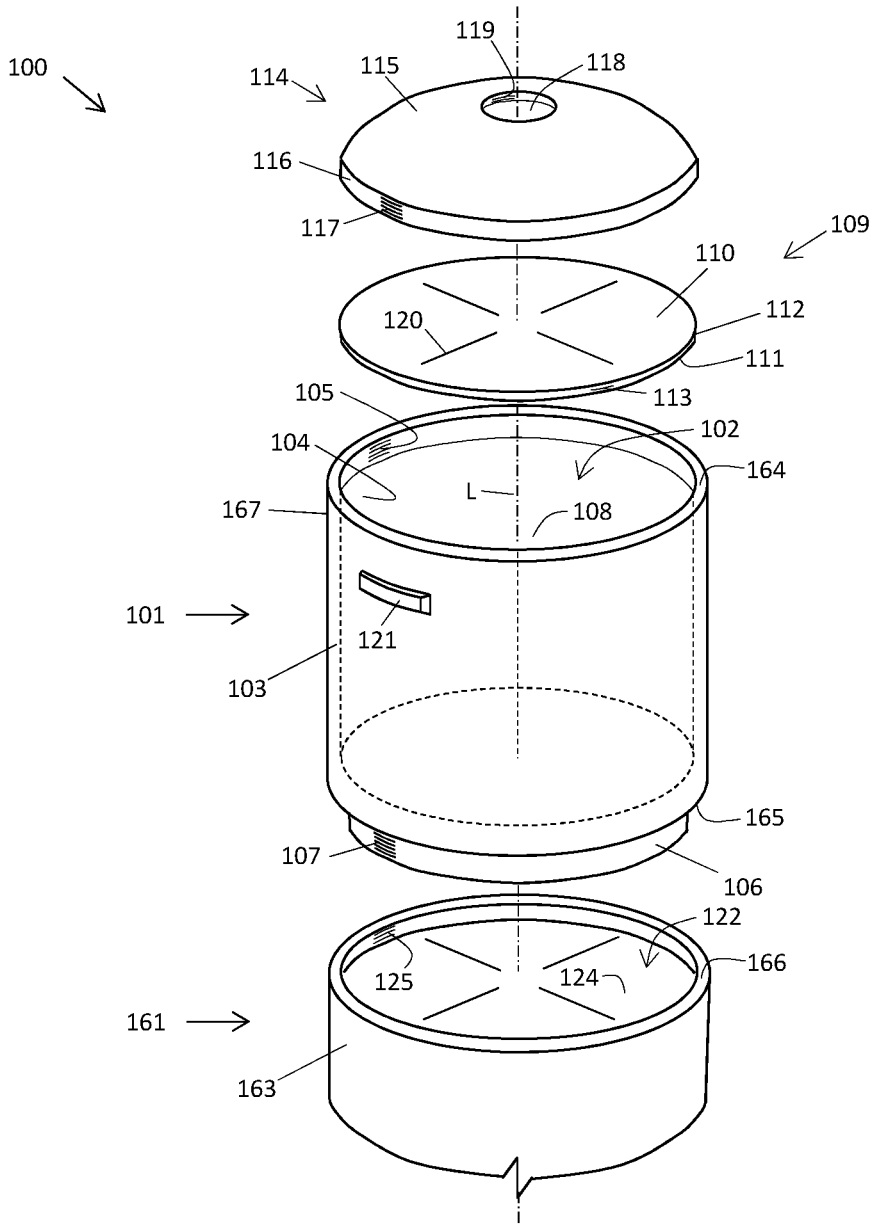
FIG. 1 illustrates an embodiment of the vertical burial container system.

FIG. 1 illustrates an illustration of the vertical burial containment 100. Vertical burial containment 100 comprises a midsection containment generally indicated by 101. Midsection containment 101 is generally cylindrical and comprises an upper circular opening 102, with upper circular opening 102 surrounding a longitudinal axis L extending through upper circular opening 102. Midsection containment 101 further comprises a midsection cylindrical wall 103, with midsection cylindrical wall having exterior and interior surfaces and comprising internal cylindrical surface 104. As illustrated, internal cylindrical surface 104 also surrounds longitudinal axis L. Additionally, internal cylindrical surface 104 comprises internal threads illustrated as 105. The internal threads 105 are adjacent to upper circular opening 102 and extend around the circumference of a region of inner cylindrical surface 104 adjacent to upper circular opening 102, such that internal threads 105 surround longitudinal axis L. Additionally, internal threads 105 have some internal thread length. "Thread length" has a meaning well known in the art and here connotes a distance over which a set of threads extends in a direction perpendicular to a pitch circle of the threads. Additionally, "internal thread" is similarly used with a meaning known in the art, and connotes a thread type whereby the minor diameter of the thread occurs at the thread crests and the major diameter of the thread occurs at the thread roots, with the major diameter greater than the minor diameter.

Midsection containment 101 further comprises an externally threaded base 106 attached to midsection cylindrical wall 103 and opposite upper circular opening 102. Externally threaded base 106 is intersected by longitudinal axis L and further comprises external threads shown as 107. External threads 107 surround longitudinal axis L and have an external thread length parallel to the longitudinal axis L. Externally threaded base 106 may be attached to midsection cylindrical wall 103 through a variety of appropriate means, including various fasteners, appropriate joining techniques, or initial fabrication of midsection cylindrical wall 103 and some portion of externally threaded base 106 as a composite unit. Further, "external thread" as used here connotes a thread type whereby the major diameter of the thread occurs at the thread crests and the minor diameter of the thread occurs at the thread roots, with the major diameter greater than the minor diameter. Additionally, and for reasons to be explained below, external threads 107 and internal threads 105 are mating threads. The term "mating threads" is used as known in the art, and means that when an internal thread set having an internal pitch diameter contacts an external thread set having an external pitch diameter with the internal pitch diameter parallel to the external pitch diameter, and when a torque is applied to the internal thread set or the external thread set, the internal thread set and the external thread set have respective thread pitches, major diameters, minor diameters, flank angles, and other parameters such that the internal thread set and the external thread set threadably engage over some length of thread engagement and with some thread fit.

Midsection containment 101 further comprises an interior volume 108 intersected by longitudinal axis L and bounded by upper circular opening 102, internal cylindrical surface 104, and externally threaded base 106.

Vertical burial containment 100 further comprises an inner cylindrical lid generally indicated by 109. Inner cylindrical lid 109 comprises first lid base 110, second lid base 111, and cylindrical lid wall 112 extending between first lid base 110 and second lid base 111. Cylindrical lid wall 112 further comprises external lid threads illustrated as 113. External lid threads 113 and internal threads 105 are mating threads in order to allow external lid threads 113 and internal threads 105 to threadably engage and provide fastening of inner cylindrical lid 109 to internal cylindrical surface 104 and midsection containment 101, effectively closing interior volume 108. Additionally, inner cylindrical lid 109 and external lid threads 113 are configured such that when external lid threads 113 threadably engage with internal threads 105, external lid threads 113 surround longitudinal axis L and longitudinal axis L intersects first lid base 110 and second lid base 111 of inner cylindrical lid 111. Additionally, for reasons explained below, a lid thread length of external lid threads 113 added to the external thread length of external threads 107 of midsection containment 101 is less than or equal to the internal thread length of internal threads 105 of midsection containment 101.

Vertical burial containment 100 additionally comprises an upper lid generally indicated by 114 and comprising a domed section 115 and a support drum 116 attached to domed section 115. Support drum 116 comprises external upper lid threads illustrated as 117. External upper lid threads 117 and internal threads 105 are mating threads to allow external upper lid threads 117 and internal threads 105 to threadably engage and provide fastening of domed section 115 and support drum 116 to internal cylindrical surface 104 and midsection containment 101. Support dome 116 and external upper lid threads 117 are configured such that when external upper lid threads 117 threadably engage with internal threads 105, external upper lid threads 117 surround longitudinal axis L and longitudinal axis L intersects doomed section 115 and support drum 116. Additionally, an upper lid thread length of external upper lid threads 117 added to the external thread length of external lid threads 113 of inner cylindrical lid 109 is less than or equal to the internal thread length of internal threads 105 comprising internal cylindrical surface 104. It is understood that support drum 116 may be attached to domed section 115 using any appropriate means, including fasteners, joining techniques, or initial fabrication as a composite unit.

Domed section 115 further comprises a topmost opening 118 and a volume within domed section 115 and adjacent to topmost opening 118. The volume is surrounded by a keyed wall which comprises domed section 115, with the keyed wall configured to provide mechanical mating between the keyed wall and an attachment inserted through the opening. For example, in some embodiments, topmost internal threads illustrated as 119 are configured to threadably engage with an externally threaded plug (not shown).

In a particular embodiment, midsection cylindrical wall 103 comprises an outer wall 167 separated from internal cylindrical surface 104 by some portion of midsection cylindrical wall 103, and outer wall 167 is substantially cylindrical over at least 90% of the area of outer wall 167. Here, "substantially cylindrical" means that a radius $R_P$ displacement perpendicular to longitudinal axis L and to a point on the surface of outer wall 167 is within 10% of a specific and constant radius $R_C$, such that $0.9 \leq R_P/R_C \leq 1.1$. In certain embodiments, $0.95 \leq R_P/R_C \leq 1.05$, and in other embodiments, $0.99 \leq R_P/R_C \leq 1.01$. Further embodiments, external threads 107 comprising externally threaded base 106 define an external thread pitch circle, and the external thread pitch circle has a radius $R_E$, where $R_E < R_P$. In other embodiments, the external thread pitch circle defines a pitch cylinder, and the curvilinear surface of the pitch cylinder is substantially parallel to the at least 90% of the area of outer wall 167.

As discussed, external threads 107 of externally threaded base 106 are dimensioned as mating threads of internal threads 105 comprising internal cylindrical surface 104, and the combined thread length of external lid threads 113 comprising inner cylindrical lid 109 and external threads 107 comprising midsection containment 101 is less than or equal to the internal thread length of internal threads 105 comprising midsection containment 101. This dimensioning allows mating of multiple midsection containments and inner cylindrical lids in order to allow handling of the group as a single rigid body. For example, FIG. 1 illustrates a section of a second midsection containment generally indicated at 161 and comprising midsection cylindrical wall 163 and upper circular opening 122. Upper cylindrical lid 124 is shown with its external lid threads threadably engaged with a portion of the internal threads 125 of midsection cylindrical wall 163. Internal threads 125 have the substantially the same dimensioning as internal threads 105 of midsection containment 101. This allows midsection containment 101 and second midsection containment 161 to be joined by the engagement of internal threads 124 of second midsection containment 161 with the external threads 107 of midsection containment 101. The various thread length relationships provided and described allow this joining to occur while accommodating the engagement of upper cylindrical lid 124 with midsection cylindrical wall 163, so that any engagement or disengagement activities between the midsection containments may occur without disruption to the interior volume of second midsection containment 161.

Figure 2:
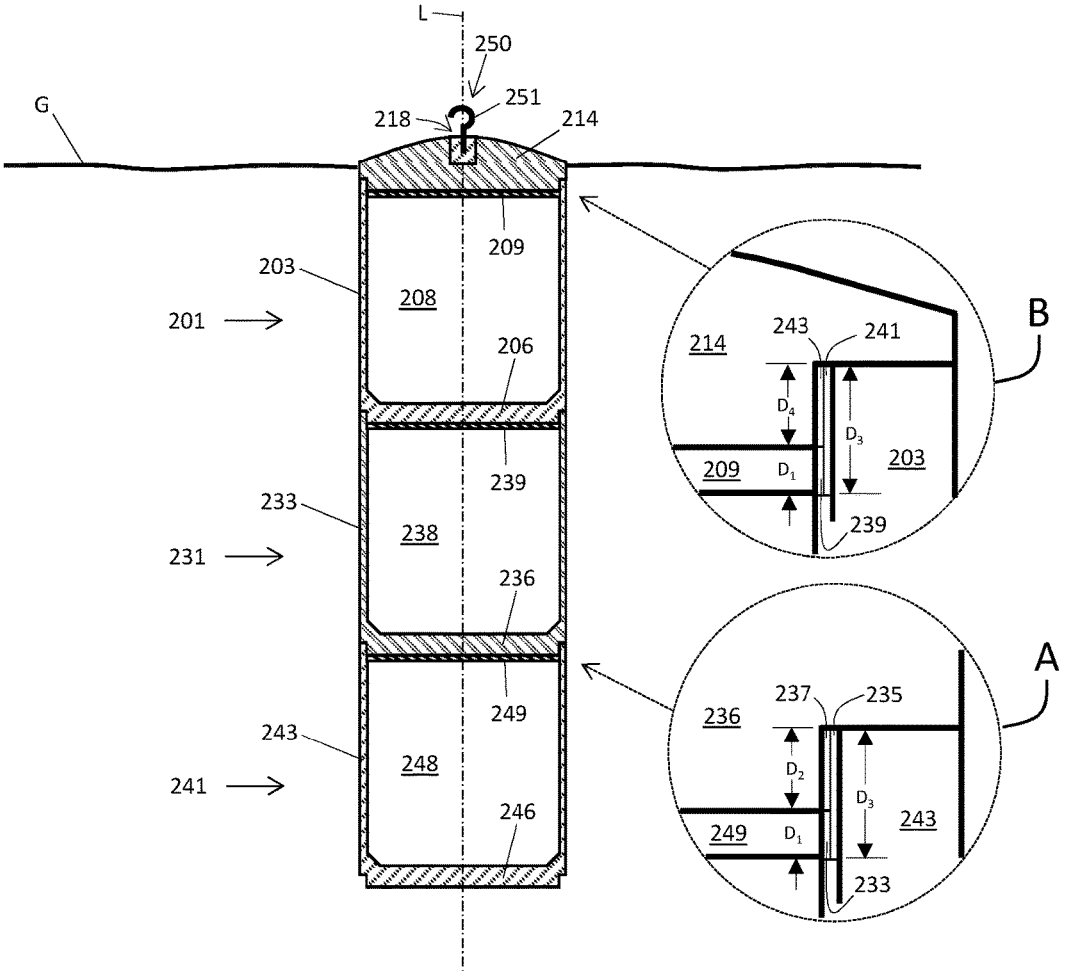
FIG. 2 illustrates a plurality of mechanically mated vertical burial systems.

As further example, FIG. 2 illustrates a plurality of mated midsection containments indicated generally as 201, 231, and 241. Midsection containment 201 comprises midsection cylindrical wall 203 and externally threaded base 206 surrounding interior volume 208. Inner cylindrical lid 209 is attached to midsection containment by threadable engagement with midsection containment 201. Similarly, midsection containment 231 comprises midsection cylindrical wall 233 and externally threaded base 236 surrounding interior volume 238 with inner cylindrical lid 239 threadably engaged with midsection containment 231. Midsection containment 241 comprises midsection cylindrical wall 243 and externally threaded base 246 surrounding interior volume 248 with inner cylindrical lid 249 threadably engaged with midsection containment 241. For reference, a longitudinal axis L is illustrated with respect to midsection containments 201, 231, and 241. The plurality of midsection containments and inner cylindrical lids are illustrated buried beneath a ground level represented as G.

FIG. 2, inset A illustrates the threadable engagement of externally threaded base 236 with midsection cylindrical wall 243, and the threadable engagement of inner cylindrical lid 249 with midsection cylindrical wall 243. Inset A shows external lid threads 233 of inner cylindrical lid 249 threadably engaged with internal threads 235 of midsection cylindrical wall 243, with external lid threads 233 having a lid thread length indicated by the distance $D_1$. Similarly, inset A shows external threads 237 of externally threaded base 236 threadably engaged with internal threads 235 of midsection cylindrical wall 243, with external threads 237 having an external thread length indicated by the distance $D_2$. Internal threads 235 of midsection cylindrical wall 243 have an internal thread length indicated by the distance $D_3$. As illustrated in the assembled condition, $D_1$, $D_2$, and $D_3$ of inset A are substantially parallel to longitudinal axis L. Additionally, $D_1$ added to $D_2$ is less than or equal to $D_3$. In a particular embodiment, a summation of $D_1$ and $D_2$ is within 20% of $D_3$ such that $0.8D_3<(D_1+D_2)<1.2D_3$, in another embodiment within 10% of $D_3$ such that $0.9D_3<(D_1+D_2)<1.1D_3$, and in another embodiment within 5% of $D_3$ such that $0.95D_3<(D_1+D_2)<1.05D_3$.

FIG. 2 further illustrates upper lid 214 threadably engaged with midsection containment 201. Inset B illustrates external lid threads 239 of inner cylindrical lid 209 threadably engaged with internal threads 241 of midsection cylindrical wall 203, with external lid threads 239 having a lid thread length indicated by the distance $D_1$, similar to external lid threads 233 of inner cylindrical lid 249. Similarly, inset B shows external upper lid threads 243 of upper lid 214 threadably engaged with internal threads 241 of midsection cylindrical wall 203, with external upper lid threads 243 having a lid thread length indicated by the distance $D_4$. Internal threads 241 of midsection cylindrical wall 203 have an internal thread length indicated by the distance $D_3$, substantially equivalent to the thread length of internal threads 235 of midsection cylindrical wall 243. In the assembled condition, $D_1$, $D_2$, and $D_4$ of inset B are substantially parallel to longitudinal axis L. Additionally, $D_1$ added to $D_4$ is less than or equal to $D_3$. In a particular embodiment, a summation of $D_1$ and $D_4$ is within 20% of $D_3$ such that $0.8D_3<(D_1+D_4)<1.2D_3$, in another embodiment within 10% of $D_3$ such that $0.9D_3<(D_1+D_4)<1.1D_3$, and in another embodiment within 5% of $D_3$ such that $0.95D_3<(D_1+D_4)<1.05D_3$.

As illustrated, upper lid 214 comprises a topmost opening 218 and a volume adjacent topmost opening 218 and surrounded by keyed walls, and configured to provide mechanical mating between the keyed wall and a removable plug 250. As illustrated, removable plug 250 further comprises a lifting extension 251 configured to transfer a force parallel to the longitudinal axis and applied to lifting extension 251 to at least the upper lid 214 and midsection containment 201 when the external upper lid threads of the support drum of upper lid 214 are threadably engaged with the internal threads comprising the internal cylindrical surface of midsection containment 201. The external threads of midsection containment 201 are configured to further transfer this force to the internal threads of midsection containment 231. The various thread engagements described allows both insertion and retrieval of the plurality of midsection containments and inner cylindrical lids depicted as a group, with the group acting as a single rigid body. Additionally, in situ, the domed section of upper lid 214 is generally intended to remain above the ground level G, with the domed section substantially forming a spherical segment for efficient distribution of compressive loading, shedding rainwater, and other functions. Additionally, once placed, removable plug 250 can be unkeyed from upper lid 214 and replaced with a different removal plug featuring markers or decoration suitable for longer term display. The substantially uniform geometry and threadable engagement of the various components described allows a plurality of mated vertical burial containers to be assembled above ground and buried as a single rigid body, and further allows the plurality of mated vertical burial containers to be removed from below ground as a single unit for mechanical mating of an additional vertical burial container.

In particular embodiments, first lid base 110 of upper cylindrical lid 109 comprises two or more lid torque points such as 120, and the lid torque points 120 are configured such that when inner cylindrical lid 110 is placed in a position perpendicular to the longitudinal axis L of midsection containment 101, a first torque having a direction parallel to the longitudinal axis L and applied to the two or more lid torque points 120 generates a rotation of inner cylindrical lid 110 about the longitudinal axis L. In a further embodiment, when external lid threads 113 of inner cylindrical lid 110 are placed in contact with internal threads 105 of midsection containment 101, the first torque results in threadable engagement of external lid threads 113 and internal threads 105. Here, a torque having a direction parallel to a line connotes a direction of rotation in accordance with the right-hand-rule, as is understood in the art.

In a further embodiment, midsection containment 101 comprises two or more midsection torque points such as 121, and midsection torque points 121 are configured such that a second torque having a direction parallel to the longitudinal axis L and applied to the two or more midsection torque points 121 generates a rotation of midsection containment 101 about the longitudinal axis L. In a further embodiment, when external threads 107 of midsection containment 101 are placed in contact with the internal threads of a second midsection containment, the second torque results in threadable engagement of external threads 107 and the internal threads of the second midsection containment.

In some embodiments, midsection containment 101 comprises an upper support surface 164 surrounding upper circular opening 122 and longitudinal axis L and a lower support surface 165 surrounding externally threaded base 106 and longitudinal L, and upper support surface 164 is substantially parallel to lower support surface 165. In another embodiment, the upper support surface and lower support surface are configured such that when the external threads of a first midsection containment are threadably engaged with the internal threads of a second midsection containment over a length of thread engaged equal to the external thread length of the external threads, the lower support surface of the first midsection containment contacts the upper support surface of the second midsection containment.

In further embodiments, when the external lid threads 113 of inner cylindrical lid 110 are threadably engaged with the internal threads 105 of midsection containment 101, a plane comprising the pitch circle of the external lid threads 113 and a plane comprising the pitch circle of the internal threads 105 are substantially parallel to each other and substantially perpendicular to the longitudinal axis L of midsection containment 101. In another embodiment, when external lid threads 113 are threadably engaged with internal threads 105, external lid threads 113 and internal threads 105 are threadably engaged over an arc 360 degrees around longitudinal axis L.

In another embodiment, when the external threads 107 of midsection containment 101 are threadably engaged with the internal threads of a second midsection containment, a pitch circle of the external threads 107 and a pitch circle of the internal threads of the second midsection containment are substantially parallel to each other and substantially perpendicular to the longitudinal axis L of midsection containment 101. In another embodiment, when external threads 107 are threadably engaged with the internal threads of the second midsection containment, external threads 107 and the internal threads of the second midsection containment are threadably engaged over an arc 360 degrees around longitudinal axis L. In a further embodiment, when the when external threads 107 are threadably engaged with the internal threads of the second midsection containment, the longitudinal axis L of midsection containment 101 is substantially parallel to a longitudinal axis of the second midsection containment.

In some embodiments, external lid threads 113 are threadably engaged with internal threads 105 over a length of engagement equal to the lid thread length, and a pitch circle of external lid threads 113 is substantially perpendicular to the longitudinal axis L, and the longitudinal axis L intersects first lid base 110 and second lid base 111. In this embodiment, external upper lid threads 117 are additionally threadably engaged with internal threads 105 over a length of engagement equal to the upper thread length, and a pitch circle of external upper lid threads 117 is substantially perpendicular to longitudinal axis L, and longitudinal axis L intersects support drum 116 and domed section 115 of upper lid 114, and inner cylindrical lid 109 is between support drum 116 and volume 108 of midsection containment 101.

In further embodiments, external threads 107 of midsection containment 101 are threadably engaged with internal threads 125 comprising an additional midsection containment 161 identical to midsection containment 101, with external threads 107 threadably engaged over a length of engagement equal to the external thread length, and lower support surface 165 of midsection containment 101 is in contact with an upper support surface 166 of additional midsection containment 161. Further in this embodiment, longitudinal axis L of midsection containment 101 is substantially parallel to a longitudinal axis of additional containment 161. In another embodiment, an additional cylindrical lid 124 identical to inner cylindrical lid 109 is threadably engaged with internal threads 125 comprising additional midsection containment 161, and additional cylindrical lid 124 is between externally threaded base 106 of midsection containment 101 and an interior volume comprising additional midsection containment 161.

As used herein, when a first line is "substantially perpendicular" to a plane, this means that a first direction vector is parallel to the first line and a second direction vector is within the plane, and the angle between the first direction vector and the second direction vector is at least 80 degrees and more preferably at least 85 degrees. Further, when a first plane is parallel to a second plane or a first curvilinear surface is parallel to a second curvilinear surface, this means that for every point on the first plane or first curvilinear surface there is first direction vector intersecting the point and perpendicular to the first plane or first curvilinear surface which is also perpendicular to the second plane or second curvilinear surface. Further, when an area on a midsection containment or other physical component described herein is substantially parallel or substantially perpendicular to a second line or second area, this means the area is coplanar with a reference plane within normal manufacturing tolerances and the reference plane is substantially parallel or substantially perpendicular to a second line or second area.

Figure 3B:
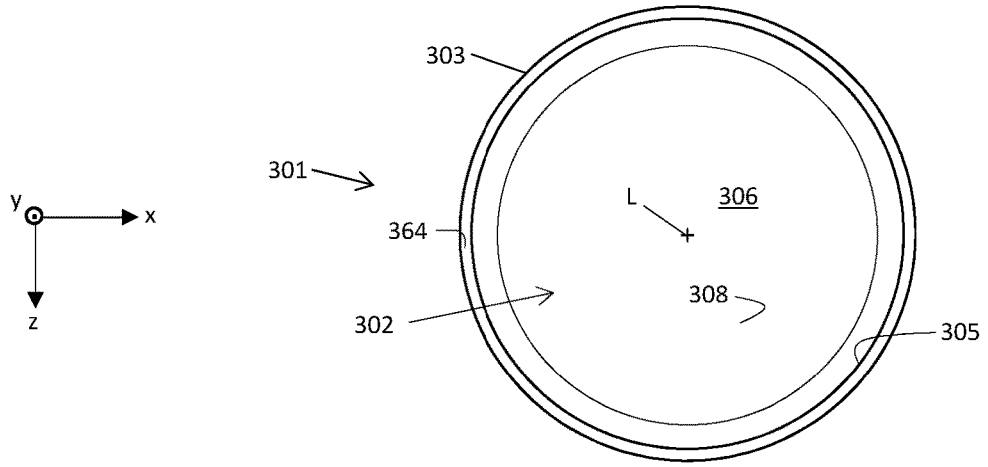
FIG. 3B illustrates a second view of the particular midsection containment.
Figure 3A:
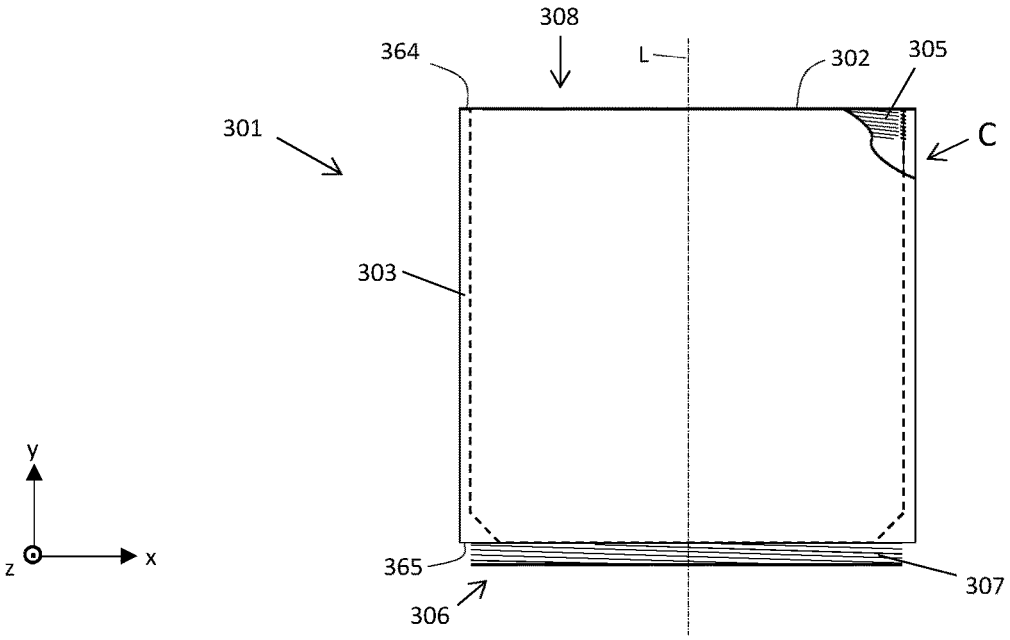
FIG. 3A illustrates a first view of a particular midsection containment.

An additional embodiment of the vertical burial container is partially illustrated at FIG. 3B in accordance with the axes shown. FIG. 3B illustrates a midsection containment 301 with upper circular opening 302 surrounding longitudinal axis L, and midsection cylindrical wall 303 comprising internal threads 305 (visible behind cutaway section C). Additionally illustrated is externally threaded base 306 attached to midsection cylindrical wall 303 and opposite upper circular opening 302, with externally threaded base 306 comprising external threads 307. Interior volume 308 is surrounded by upper circular opening 302, midsection cylindrical wall 303, and externally threaded base 306. Midsection cylindrical wall 303 further comprises upper support area 364 and lower support area 365. Midsection containment 301 also comprises interior volume 308. At FIG. 3A, midsection containment 301, upper circular opening 302, midsection cylindrical wall 303, internal threads 305, externally threaded base 306, interior volume 308, and upper support area 364 are illustrated in accordance with the axes shown.

Figure 4B:
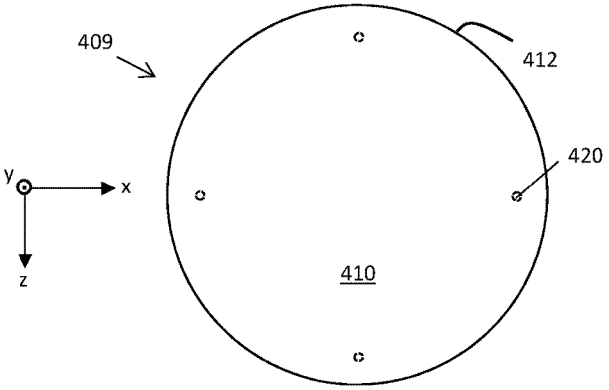
FIG. 4B illustrates a second view of the particular inner cylindrical lid.
Figure 4A:
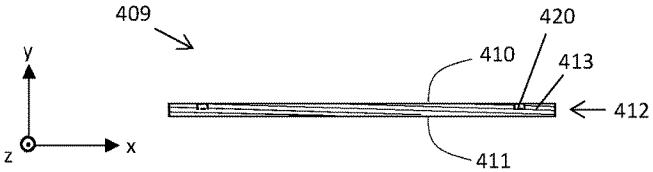
FIG. 4A illustrates a first view of a particular inner cylindrical lid.

FIG. 4B illustrates an inner cylindrical lid 409 for the additional embodiment in accordance with the axes shown. Inner cylindrical lid 409 comprises first lid base 410, second lid base 411, and cylindrical lid wall 412, with cylindrical lid wall 412 comprising external lid threads 413. Inner cylindrical lid 409 further comprises torque point 420. At FIG. 4A, inner cylindrical lid 409, first lid base 410, cylindrical lid wall 412, and torque point 420 are illustrated in accordance with the axes shown.

Figure 5B:
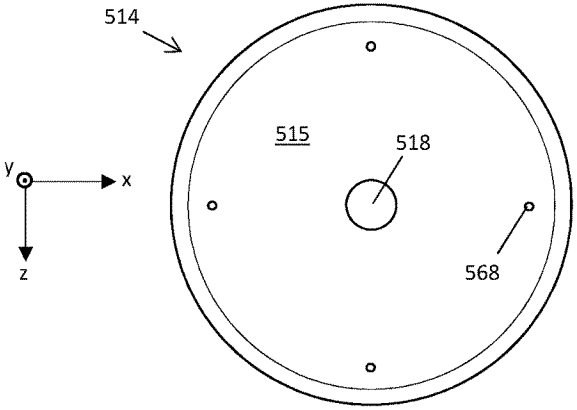
FIG. 5B illustrates a second view of the particular upper lid.
Figure 5A:
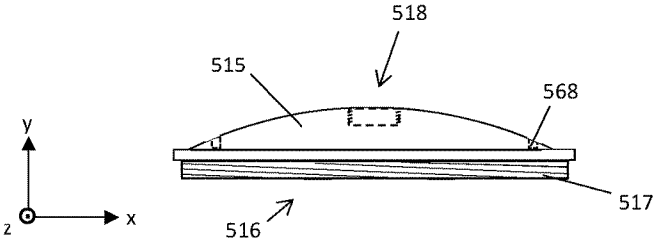
FIG. 5A illustrates a first view of a particular upper lid.

FIG. 5B illustrates an upper lid 514 for the additional embodiment in accordance with the axes shown. Upper lid 514 comprises domed section 515 and a support drum 516, with support drum 516 comprising external upper lid threads 517. Domed section 515 further comprises topmost opening 518 and a torque point 568. At FIG. 5B, Upper lid 514, domed section 515, topmost opening 518 and torque point 568 are illustrated in accordance with the axes shown.

The disclosure further provides a method for burying a plurality of vertical burial containers. The method comprises obtaining a midsection containment comprising an upper circular opening surrounding a longitudinal axis extending through the upper circular opening and a midsection cylindrical wall adjacent the upper circular opening, with the midsection cylindrical wall comprising an internal cylindrical surface and an outer wall. Within the midsection containment obtained, the internal cylindrical surface surrounds the longitudinal axis and the outer wall is separated from the internal cylindrical surface by some portion of the midsection cylindrical wall, with the outer wall is substantially cylindrical over at least 90% of the area of the outer wall. Further, the internal cylindrical surface comprises internal threads, where the internal threads are adjacent to the upper circular opening, and where the internal threads surround the longitudinal axis, and where a pitch circle of the internal threads is substantially perpendicular to the longitudinal axis, and where the internal threads have an internal thread length. The midsection containment obtained further comprises an upper support surface surrounding the upper circular opening and the longitudinal axis and a lower support surface surrounding the longitudinal axis, with the lower support surface is substantially perpendicular to the longitudinal axis and substantially parallel to the upper support surface. The midsection containment obtained further comprises an externally threaded base attached to the midsection cylindrical wall opposite the upper circular opening with the externally threaded base intersected by the longitudinal axis, and comprising external threads surrounding the longitudinal axis. The external threads and the internal threads are mating threads, and the external threads have an external thread length and have a pitch circle substantially perpendicular to the longitudinal axis. The midsection containment further comprises an interior volume intersected by the longitudinal axis and bounded by the upper circular opening, the internal cylindrical surface, and the externally threaded base.

The method further comprises mechanically mating an inner cylindrical lid to the midsection containment. The inner cylindrical lid comprises a first lid base, a second lid base and a cylindrical lid wall between the first lid base and the second lid base, and comprises external lid threads having a have a lid thread length, where the lid thread length added to the external thread length of the external threads comprising the externally threaded base is less than or equal to the internal thread length of the internal threads comprising the internal cylindrical surface. The method further comprises applying a torque to a lid torque point comprising the inner cylindrical lid and threadably engaging the external lid threads with the internal threads over a length of engagement equal to the lid thread length and to a point where a length of internal threads equal to at least the external thread length of the midsection containment is exposed between the inner cylindrical lid and the upper circular opening of the midsection containment.

The method further comprises mechanically mating an upper lid to the midsection containment. The upper lid comprises a domed section and a support drum, with the domed section comprising a topmost opening and a volume surrounded by a keyed wall adjacent the topmost opening. An external lid is mechanically mated to the keyed wall with the external plug comprising a lifting extension. The support drum comprising external upper lid threads where the upper lid thread length added to the lid thread length of the external lid threads is less than or equal to the internal thread length of the internal threads of the internal cylindrical surface. The method further comprises applying a torque to the upper lid or external plug and threadably engaging the external upper lid threads with the internal threads over a length of engagement equal to the upper lid thread length, such that the upper cylindrical lid is between the upper lid and the interior volume comprising the midsection containment.

The method further comprises mechanically mating the midsection containment to an additional containment having the same manufacturing dimensions as the midsection containment. The method comprises applying a torque to the midsection containment or additional midsection containment and threadably engaging the external threads of the midsection containment with a set of internal threads comprising the additional containment until the lower support area of the midsection containment contacts an upper support area comprising the additional containment. Typically an additional cylindrical lid having the same manufacturing dimensions as the upper cylindrical lid is threadably engaged with the set of internal threads comprising the additional containment, and the additional cylindrical lid is between the midsection containment and an interior volume of the additional containment. The mated midsection containment threadably engaged with the upper cylindrical lid and the upper lid and further threadably engaged with the additional midsection containment forms a plurality of vertical burial cylinders.

The method further comprises generating a borehole in a ground surface with the borehole having a diameter at least equal to a diameter of the cylindrical area over at least 90% of the area of the outer wall. The method further comprises applying a lifting force to the lifting extension of the upper lid and positioning the plurality of vertical burial containers within the borehole. In certain embodiments, the method further comprises removing the external plug from the volume adjacent the topmost opening and mechanically mating an alternate external plug to the keyed walls of the volume adjacent the topmost opening.

Thus, provided here is a vertical burial container comprising a midsection containment, upper cylindrical lid, interior volume, and a domed upper lid. The midsection containment comprises a set of internal threads surrounding the upper circular opening further comprises a set of external threads surrounding the base. The external threads and the internal threads are mating threads to allow multiple containers to be threadably engaged for handling as a single unit. The vertical burial container further comprises an upper cylindrical lid having external threads allowing the upper cylindrical lid to threadably engage with the internal threads of the midsection containment, isolating the interior volume. The vertical burial system additionally comprises an upper lid having internal threads which threadably engage with the internal threads of the midsection containment. The upper lid allows a lifting fixture to be mechanically attached in order that a lifting force applied to the lifting fixture may act throughout a plurality of mated containers for handling as a single unit. Typically the various threads have respective thread lengths to accommodate either an upper lid or another midsection containment to be threaded into the internal threads without displacing the inner cylindrical lid isolating the interior volume.

Accordingly, this description provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A vertical burial container comprising:

a midsection containment, the midsection containment comprising:

an upper circular opening where the upper circular opening surrounds a longitudinal axis extending through the upper circular opening;

a midsection cylindrical wall adjacent the upper circular opening and comprising an internal cylindrical surface surrounding the longitudinal axis, where the internal cylindrical surface comprises internal threads, where the internal threads are adjacent to the upper circular opening, and where the internal threads surround the longitudinal axis, and where the internal threads have an internal thread length;

an externally threaded base attached to the midsection cylindrical wall opposite the upper circular opening where the externally threaded base is intersected by the longitudinal axis, and where externally threaded base comprises external threads, where the external threads surround the longitudinal axis, and where the external threads and the internal threads comprising the internal cylindrical surface are mating threads, and where the external threads have an external thread length; and an interior volume intersected by the longitudinal axis and bounded by the upper circular opening, the internal cylindrical surface, and the externally threaded base;

an inner cylindrical lid, the inner cylindrical lid comprising a first lid base and a second lid base and comprising a cylindrical lid wall between the first lid base and the second lid base, and the cylindrical lid wall comprising external lid threads, where the external lid threads and the internal threads comprising the internal cylindrical surface are mating threads, and where the external lid threads have a lid thread length, where the lid thread length added to the external thread length of the external threads comprising the externally threaded base is less than or equal to the internal thread length of the internal threads comprising the internal cylindrical surface; and an upper lid comprising:

a domed section, the domed section comprising a topmost opening and a volume adjacent the topmost opening, and the volume surrounded by a keyed wall, and the keyed wall configured to provide mechanical mating between the keyed wall and an attachment inserted through the topmost opening; and a support drum attached to the domed section, and the support drum comprising external upper lid threads, where the external upper lid threads and the internal threads comprising the internal cylindrical surface are mating threads, and where the external upper lid threads have an upper thread length where the upper lid thread length added to the lid thread length of the external lid threads comprising the inner cylindrical lid is less than or equal to the internal thread length of the internal threads comprising the internal cylindrical surface.

2. The vertical burial container of claim 1 where a pitch circle of the internal threads comprising the internal cylindrical surface is substantially perpendicular to the longitudinal axis, and where a pitch circle of the external threads comprising the externally threaded base is substantially perpendicular to the longitudinal axis.

3. The vertical burial container of claim 2 where the midsection cylindrical wall further comprises:

an upper support surface surrounding the upper circular opening and the longitudinal axis;

a lower support surface surrounding the longitudinal axis, where the lower support surface is substantially perpendicular to the longitudinal axis and where the lower support surface is substantially parallel to the upper support surface.

4. The vertical burial container of claim 3 where the external threads are configured to provide an external thread length such that when the external threads are threadably engaged over a length of engagement equal to the external thread length with a set of internal threads comprising an additional containment identical to the midsection containment, the lower support surface of the midsection containment contacts the upper support surface of the additional containment.

5. The vertical burial container of claim 4 where the external threads are configured such that when the external threads are threadably engaged over the length of engagement equal to the external thread length with the set of internal threads comprising the additional containment identical to the midsection containment, the longitudinal axis of the midsection containment is substantially parallel to a longitudinal axis of the additional containment.

6. The vertical burial container of claim 1 further comprising an external plug configured to mechanically mate with the keyed wall comprising the upper lid, where the external plug comprises a lifting extension configured to transfer a force parallel to the longitudinal axis and applied to the lifting extension to the upper lid and the midsection containment when the external upper lid threads of the support drum are threadably engaged with the internal threads comprising the internal cylindrical surface.

7. The vertical burial container of claim 6 where the external upper lid threads are configured such that when the external upper lid threads are threadably engaged over a length of engagement equal to the upper thread length with the internal threads comprising the internal cylindrical surface, a pitch circle of the upper external threads is substantially perpendicular to the longitudinal axis of the midsection containment, and the longitudinal axis of the midsection containment intersects the domed section and the support drum of the upper lid, and the external upper lid threads surround the longitudinal axis of the midsection containment.

8. The vertical burial container of claim 7 where the domed section comprises a spherical cap and the spherical cap comprises the topmost opening and further comprises a spherical cap base, and where the support drum comprises a first drum base and a second drum base and a cylindrical drum wall between the first drum base and the second drum base, and where the spherical cap base is attached to the first drum base and the cylindrical drum wall comprises the external upper lid threads.

9. The vertical burial container of claim 1 where the external lid threads are configured such that when the external lid threads of the inner cylindrical lid are threadably engaged over a length of engagement equal to the lid thread length with the internal threads of the midsection containment, a pitch circle of the external lid threads is substantially perpendicular to the longitudinal axis of the midsection containment, and the longitudinal axis of the midsection containment intersects the first lid base and the second lid base of the inner cylindrical lid, and the external lid threads of the inner cylindrical lid surround the longitudinal axis of the midsection containment.

10. The vertical burial container of claim 1 where a pitch circle of the internal threads comprising the inner cylindrical surface of the midsection containment is substantially perpendicular to the longitudinal axis, and where:

the external upper lid threads comprising the upper lid are configured such that when the external upper lid threads are threadably engaged over a length of engagement equal to the upper thread length with the internal threads comprising the internal cylindrical surface, a pitch circle of the upper external threads is substantially perpendicular to the longitudinal axis of the midsection containment, and the longitudinal axis of the midsection containment intersects the domed section and the support drum of the upper lid, and the external upper lid threads surround the longitudinal axis of the midsection containment;

the external lid threads comprising the inner cylindrical lid are configured such that when the external lid threads are threadably engaged over a length of engagement equal to the lid thread length with the internal threads comprising the internal cylindrical surface, a pitch circle of the external lid threads is substantially perpendicular to the longitudinal axis of the midsection containment, and the longitudinal axis of the midsection containment intersects the first lid base and the second lid base of the inner cylindrical lid, and the external lid threads of the inner cylindrical lid surround the longitudinal axis of the midsection containment; and the external threads comprising the midsection containment are configured such that when the external threads are threadably engaged over the length of engagement equal to the external thread length with a set of internal threads comprising an additional containment identical to the midsection containment, the longitudinal axis of the midsection containment is substantially parallel to a longitudinal axis of the additional containment; and a pitch circle of the external threads is substantially perpendicular to the longitudinal axis of the midsection containment and substantially perpendicular to the longitudinal axis of the additional containment.

11. The vertical burial container of claim 1 where the first lid base comprises two or more lid torque points where the two or more lid torque points are configured such that a first torque having a direction parallel to the longitudinal axis and applied to the two or more lid torque points generates a rotation of the inner cylindrical lid about the longitudinal axis.

12. The vertical burial container of claim 11 where the midsection containment comprises two or more midsection torque points where the two or more midsection torque points are configured such that a second torque having the direction parallel to the longitudinal axis and applied to the to the two or more midsection torque points generates a rotation of the midsection containment about the longitudinal axis.

13. A vertical burial container comprising:

a midsection containment, the midsection containment comprising:

an upper circular opening where the upper circular opening surrounds a longitudinal axis extending through the upper circular opening;

a midsection cylindrical wall adjacent the upper circular opening and comprising:

an internal cylindrical surface surrounding the longitudinal axis, where the internal cylindrical surface comprises internal threads, where the internal threads are adjacent to the upper circular opening, and where the internal threads surround the longitudinal axis, and where a pitch circle of the internal threads is substantially perpendicular to the longitudinal axis, and where the internal threads have an internal thread length;

an upper support surface surrounding the upper circular opening and the longitudinal axis; and a lower support surface surrounding the longitudinal axis, where the lower support surface is substantially perpendicular to the longitudinal axis and where the lower support surface is substantially parallel to the upper support surface;

an externally threaded base attached to the midsection cylindrical wall opposite the upper circular opening where the externally threaded base is intersected by the longitudinal axis, and where externally threaded base comprises external threads, where the external threads surround the longitudinal axis, and where the external threads and the internal threads comprising the internal cylindrical surface are mating threads, and where the external threads have an external thread length, and where a pitch circle of the external threads is substantially perpendicular to the longitudinal axis; and an interior volume intersected by the longitudinal axis and bounded by the upper circular opening, the internal cylindrical surface, and the externally threaded base;

an inner cylindrical lid, the inner cylindrical lid comprising a first lid base and a second lid base and comprising a cylindrical lid wall between the first lid base and the second lid base, and the cylindrical lid wall comprising external lid threads having a have a lid thread length, where the external lid threads are threadably engaged with the internal threads over a length of engagement equal to the lid thread length, and where a pitch circle of the external lid threads is substantially perpendicular to the longitudinal axis, and where the longitudinal axis intersects the first lid base and the second lid base, and where the lid thread length added to the external thread length of the external threads comprising the externally threaded base is less than or equal to the internal thread length of the internal threads comprising the internal cylindrical surface; and an upper lid comprising:

a domed section comprising a spherical cap and a spherical cap base, where the spherical cap comprises a topmost opening and a volume adjacent the topmost opening, where the volume is surrounded by a keyed wall and the keyed wall is configured to provide mechanical mating between the keyed wall and an attachment inserted through the topmost opening; and a support drum comprising a first drum base and a second drum base and a cylindrical drum wall between the first drum base and the second drum base, where the first drum base is attached to the spherical cap base comprising the domed section, where the cylindrical drum wall comprises external upper lid threads having an upper thread length, where the external upper lid threads are threadably engaged with the internal threads over a length of engagement equal to the upper thread length and the longitudinal axis intersects the first drum base, the second drum base, and the domed section, and where a pitch circle of the external upper lid threads is substantially perpendicular to the longitudinal axis, and where the upper lid thread length added to the lid thread length of the external lid threads is less than or equal to the internal thread length of the internal threads.

14. The vertical burial container of claim 13 further comprising an external plug mechanically mated with the keyed wall comprising the upper lid, where the external plug comprises a lifting extension configured to transfer a force parallel to the longitudinal axis and applied to the lifting extension to the upper lid and the midsection containment.

15. The vertical burial container of claim 14 where the external threads are configured to provide an external thread length such that when the external threads are threadably engaged over a length of engagement equal to the external thread length with a set of internal threads comprising an additional containment identical to the midsection containment, the lower support surface of the midsection containment contacts the upper support surface of the additional containment.

16. The vertical burial container of claim 14 where the external threads are configured such that when the external threads are threadably engaged over the length of engagement equal to the external thread length with the set of internal threads comprising the additional containment identical to the midsection containment, the longitudinal axis of the midsection containment is substantially parallel to a longitudinal axis of the additional containment.

17. The vertical burial container of claim 14 further comprising an additional containment identical to the midsection containment, and the external threads of the midsection containment threadably engaged with a set of internal threads comprising the additional containment over a length of engagement equal to the external thread length, and the lower support surface of the midsection containment contacting an upper support surface of the additional containment and the longitudinal axis of the midsection containment substantially parallel to a longitudinal axis of the additional containment.

18. The vertical burial container of claim 17 further comprising an additional cylindrical lid identical to the inner cylindrical lid and a set of external lid threads comprising the additional cylindrical lid threadably engaged with the set of internal threads comprising the additional containment, and the additional cylindrical lid between the externally threaded base of the midsection containment and an interior volume comprising the additional containment.

* * * * *